US006764334B2

(12) United States Patent
Tsuji et al.

(10) Patent No.: US 6,764,334 B2
(45) Date of Patent: Jul. 20, 2004

(54) CONNECTOR

(75) Inventors: Takeshi Tsuji, Yokkaichi (JP); Masaaki Tabata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/353,108

(22) Filed: Jan. 28, 2003

(65) Prior Publication Data

US 2003/0157833 A1 Aug. 21, 2003

(30) Foreign Application Priority Data

Feb. 15, 2002 (JP) ..... 2002-038881

(51) Int. Cl.[7] ..... H01R 13/40
(52) U.S. Cl. ..... 439/595; 439/752; 439/744
(58) Field of Search ..... 439/595, 752, 439/744

(56) References Cited

U.S. PATENT DOCUMENTS 5,980,318 A * 11/1999 Morello et al. ..... 439/595
5,997,364 A * 12/1999 Matsuoka et al. ..... 439/752
6,068,512 A * 5/2000 Sugie ..... 439/595
6,106,340 A * 8/2000 Myer et al. ..... 439/752

FOREIGN PATENT DOCUMENTS

JP 5-190228 * 7/1993

* cited by examiner

*Primary Examiner*—Truc Nguyen
(74) *Attorney, Agent, or Firm*—Anthony J. Casella; Gerald E. Hespos

(57) ABSTRACT

A connector has a housing (10) with cavities (11) for receiving terminal fittings (40). Locks (17) lock the terminal fittings (40) in the cavities (11) and serve also as partition walls (20) between cavities (11) for the miniaturization of the connector. Upside-down insertion preventing portions (46) are provided on the terminal fittings (40), but are disposed so as not to interfere with the corresponding lock (17). The upside-down insertion preventing portions (46) also do not interfere with the lock (17) of the adjacent cavity (11) even if both the upside-down insertion preventing portion (46) and the lock (17) are near the front end and are on opposite sides. Since the upside-down insertion preventing portions (46) and the locks (17) are near the front end, inserting resistance is low and an earlier detection of upside-down insertion is realized.

15 Claims, 13 Drawing Sheets

(a)

(b)

CONNECTOR

BACKGROUND OF THE INVENTION

1. Field of the Invention

The invention relates to a connector with a function of detecting the upside-down insertion of a terminal fitting.

2. Description of the Related Art

A known connector has a housing formed with cavities and terminal fittings that are inserted in the cavities. Locks are provided along the upper or bottom wall of the cavities to lock the terminal fittings. The terminal fitting is formed with an upside-down insertion preventing projection and the cavity is provided with an escaping groove for receiving the upside-down insertion preventing projection when the terminal fitting is inserted in a proper orientation. The cavity also has a receiving portion for contacting the upside-down insertion preventing portion to prevent further insertion of the terminal fitting when the terminal fitting is upside down. A connector of this general type is disclosed in Japanese Unexamined Patent Publication No. 5-190228.

The terminal fitting of the above-described connector slides in contact with the lock and resiliently deforms the lock in the process of inserting the terminal fitting. Frictional resistance resulting from the sliding contact serves as insertion resistance. Thus, it is desirable to provide the lock as close to the front end of the cavity as possible to shorten a sliding-contact stroke between the lock and the terminal fitting.

On the other hand, the upside-down insertion-preventing portion should be at the front end of the terminal fitting so that an upside-down insertion is detected at an earliest stage of the terminal fitting inserting process.

Both the lock and the upside-down insertion preventing portion should be near the front ends of the cavity and the terminal fitting to reduce insertion resistance and achieve early detection of the upside-down insertion. Thus, the upside-down insertion preventing portion and the lock are provided on opposite sides of the terminal fitting to avoid interference of the lock and the upside-down insertion-preventing portion.

Locks can be provided at substantially at the same heights as partition walls between the cavities and can form parts of the partition walls to reduce the height of a connector that has vertically arranged cavities. In this situation, the upside-down insertion-preventing portions are in deformation permitting spaces for the locks of the cavities located right above or below. Thus, there is a possibility that the lock interferes with the upside-down insertion-preventing portion when the lock is deformed resiliently.

The present invention was developed in view of the above problem, and an object thereof is to improve the operability of a connector.

SUMMARY OF THE INVENTION

The invention relates to a connector comprising a housing formed with cavities for receiving terminal fittings. Locks are provided in the cavities for engaging and locking the terminal fittings. Some locks form at least parts of partition walls between adjacent cavities.

Each terminal fitting may have an upside-down insertion-preventing portion. The upside-down insertion-preventing portions may be disposed so as not to interfere with the locks along an inserting direction of the terminal fittings.

The upside-down insertion-preventing portions and locks are near the front ends of the corresponding terminal fittings and cavities. Accordingly, there is a low insertion resistance and an early detection of upside-down insertion. Additionally, the upside-down insertion-preventing portions and the locks preferably are on the opposite sides, and do not interfere with locks of adjacent cavities.

Each cavity preferably has a receiving portion for contacting the upside-down insertion-preventing portion and preventing further insertion of the terminal fitting when the terminal fitting is inserted upside down.

Each terminal fitting may be a male terminal fitting with a tab projecting forward through an opening in a front wall of the corresponding cavity when the male terminal fitting is inserted properly. The receiving portion preferably is at a position to contact the upside-down insertion-preventing portion before the front end of the tab strikes against the front wall of the cavity.

Each lock that forms part of the partition wall between the cavities may have at least one thin portion formed by partially cutting a surface of the lock substantially opposite from the terminal fitting to be locked by the lock. Each partition wall between the cavities preferably is formed with an excessive deformation-preventing portion facing the thin portion. Thus, excessive deformation of the lock can be prevented while the desired deformation of the lock is permitted. Further, a sufficient rigidity is secured for the lock by forming the thin portion only across part of the width of the lock.

Each cavity preferably comprises a receiving surface arranged substantially normal to an inserting direction of the terminal fitting into the cavity. Thus, a portion of the terminal fitting engages the receiving surface of the cavity and is prevented from moving beyond the proper insertion position.

The lock preferably is wider than the terminal fitting, and the thin portion preferably projects laterally beyond the terminal fitting.

A retainer preferably is insertable along the inserting direction, to doubly lock the terminal fittings in the cavities.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
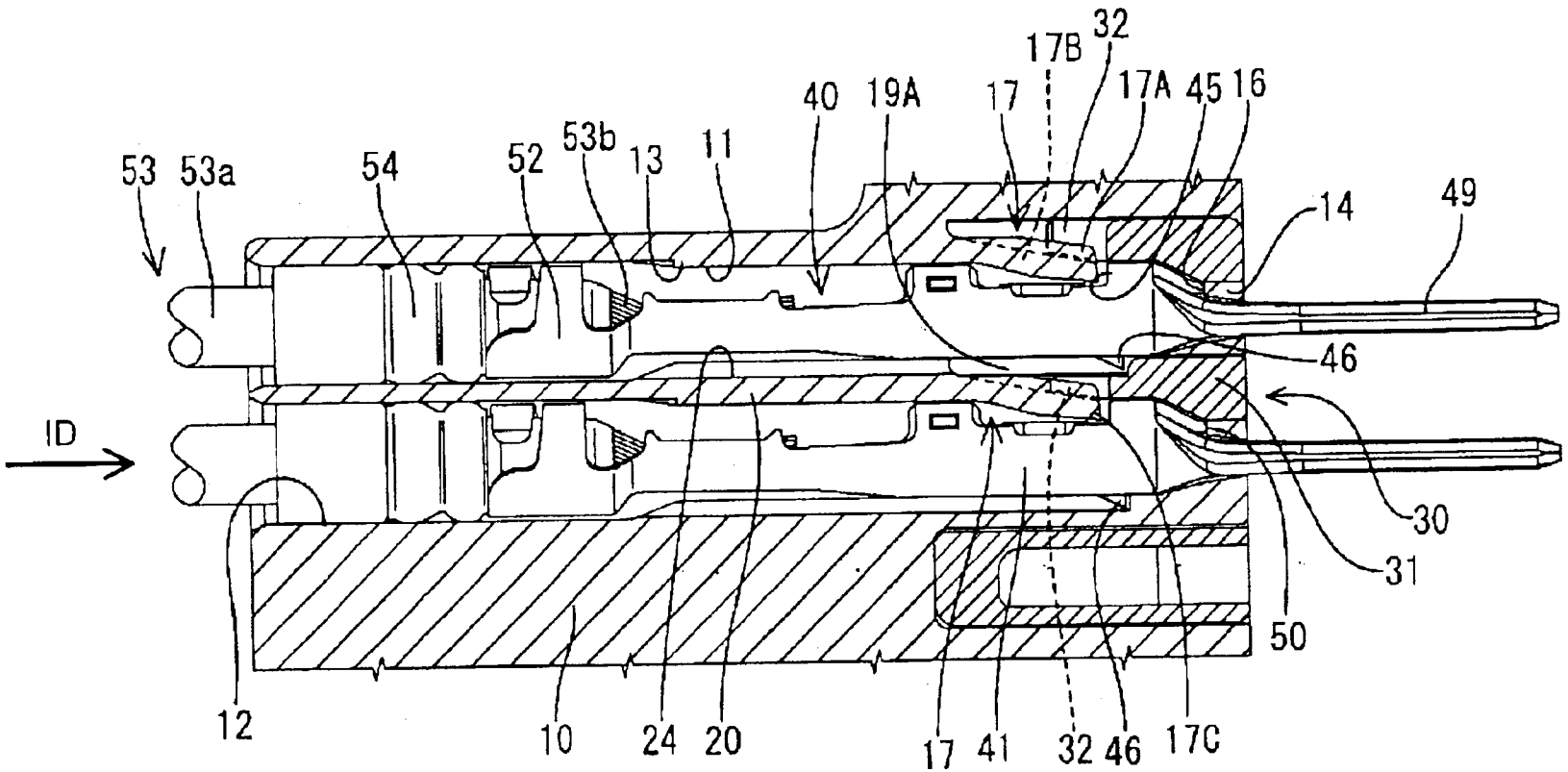
FIG. 1 is a section of a connector according to the invention.
Figure 2:
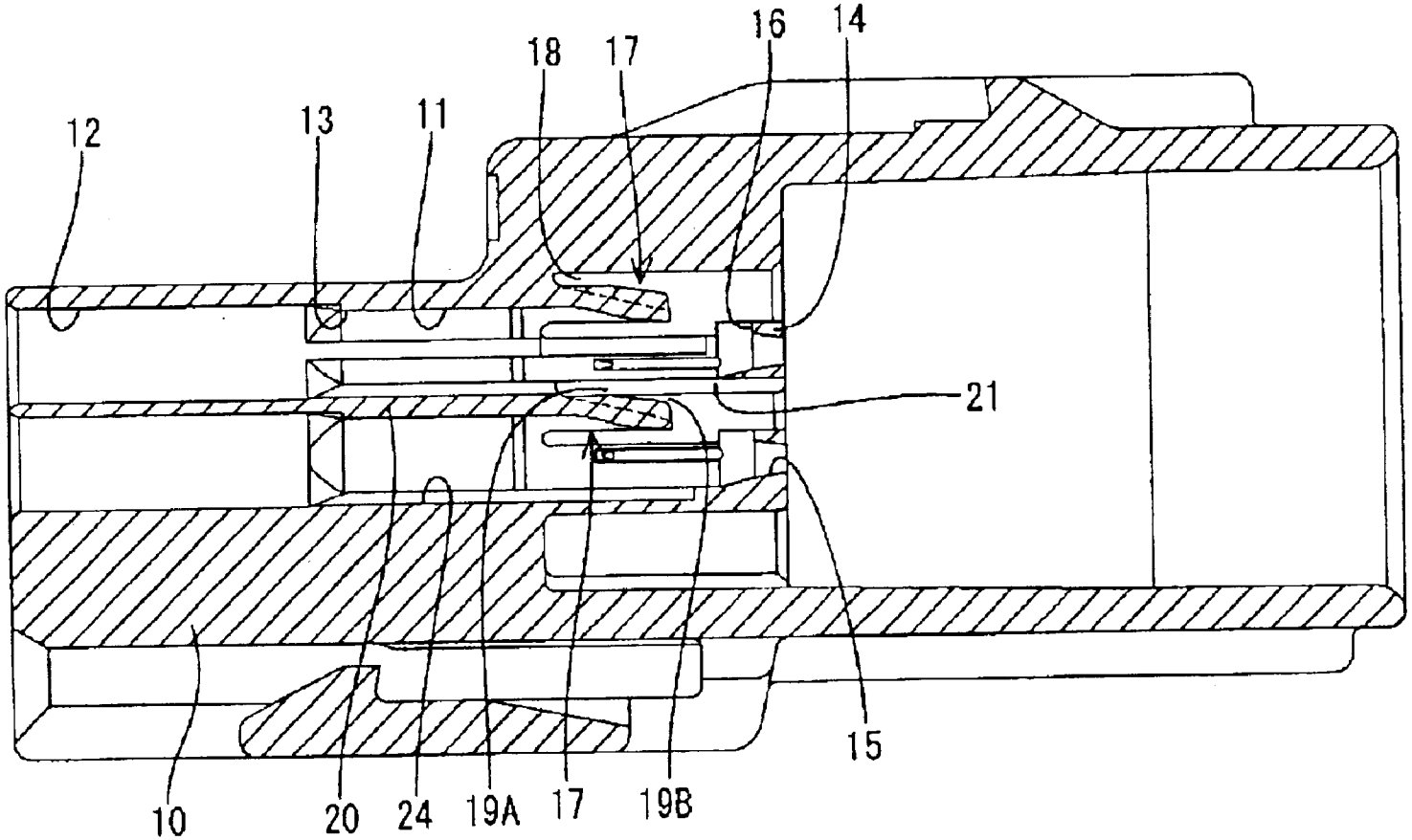
FIG. 2 is a section of a housing.
Figure 3:
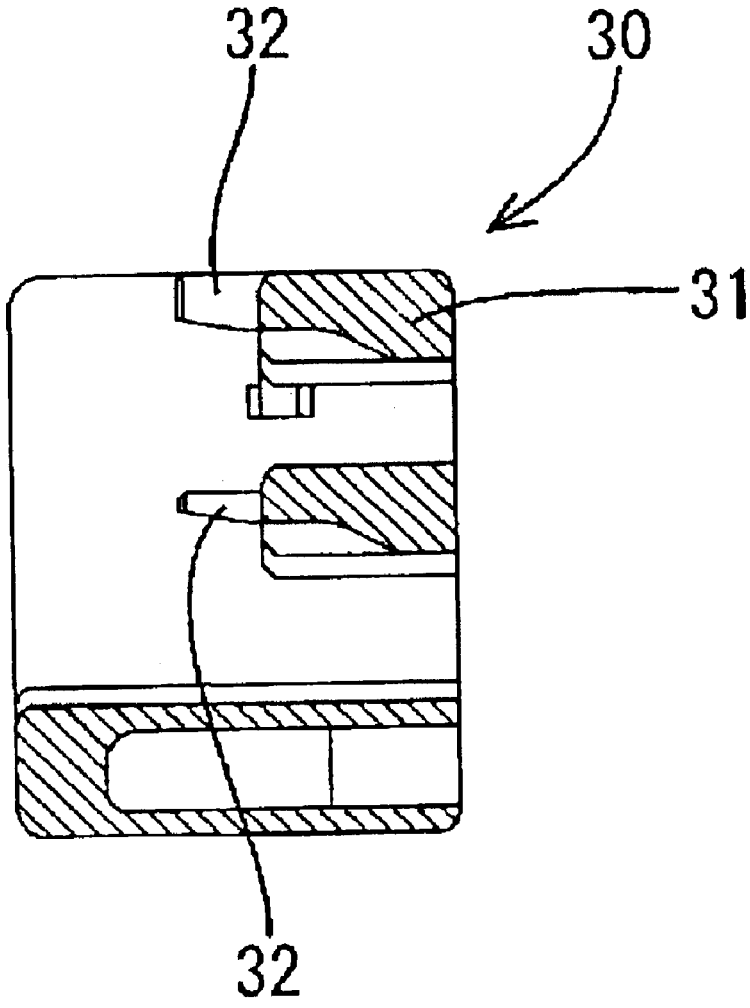
FIG. 3 is a section of a front retainer.

A connector according to the invention has a housing identified by the numeral 10 in FIGS. 1 to 10. The housing 10 is formed e.g. of a synthetic resin and has cavities 11 that open at opposite front and rear ends of the housing 10. The cavities 11 are arranged substantially side by side at upper and lower stages. A substantially round sealing surface 12 is defined on the inner periphery of the rear end of each cavity 11. A portion of each cavity 11 before the sealing surface 12 has a substantially rectangular cross section, and a step-shaped receiving portion 13 is formed on the ceiling before the sealing surface 12. The receiving portion 13 is more backward than the longitudinal center of the cavity 11.

A front wall 14 stands up from the front end of the bottom wall of the cavity 11 and has an opening 15 for receiving a tab of a male terminal fitting. A substantially flat receiving surface 16 projects from the rear of the front wall 14 above the opening 15 and is aligned substantially normal to an inserting direction ID into the cavity 11.

A transversely symmetrical lock 17 is cantilevered forward from a front portion of the ceiling wall of each cavity 11. Each lock 17 has a thick middle 17A with a relatively large vertical dimension and thin sides 17B with relatively small vertical dimensions. Lower surfaces of the thick and thin portions 17A, 17B face into the respective cavity 11 and are substantially continuous and flush with each other. However, the thick middle 17A projects up beyond the thin sides 17B at the upper surface of the lock 17. Accordingly, the lock 17 has a substantially triangular or convex shape when seen in cross-section, and the thick middle 17A defines an apex. The front bottom edge of the lock 17 defines a locking section 17C for engaging a terminal fitting.

Each cavity 11 at the upper stage has a deformation permitting space 18 that opens to the front end of the housing 10. Each cavity 11 at the lower stage has deformation permitting spaces 19A, 19B that correspond respectively to the thick middle 17A and the thin sides 17B of the respective lock 17. The deformation permitting space 19A for the thick middle 17A vertically penetrates the widthwise center of a partition wall 20 between the upper and lower cavities 11 and provides communication between the upper and lower cavities 11. Thus, the upper surface of the thick middle 17A of each lock 17 in the lower stage directly faces the cavity 11 at the upper stage. The deformation permitting spaces 19B for the thin sides 17B cut partially into the opposite sides of the bottom of the partition wall 20 to define left and right excessive deformation preventing portions 21 that contact the thin sides 17B and prevent deformation of the lock 17 beyond its resiliency limit. The deformation permitting spaces 19A, 19B for the lower stage cavities 11 also open to the front of the housing 10.

The connector also includes a front retainer 30 made e.g. of a synthetic resin. The front retainer 30 has fittable portions 31 that fit into mold removal spaces formed in the front of the housing 10 during the molding of the locks 17 and the deformation permitting spaces 18, 19A, 19B. Deformation preventing portions 32 project from the fittable portions 31 and into the respective deformation permitting spaces 18, 19B for preventing deformation of the locks 17 into the deformation permitting spaces 18, 19A, 19B. Left and right deformation preventing portions 32 are provided for each lock 17 and correspond to the two thin portions 17B of each lock 17.

The deformation preventing portions 32 that fit into the deformation permitting spaces 18 at the upper stage contact the upper surfaces of the thin sides 17B and the ceiling surfaces of the deformation permitting spaces 18 to prevent deformation of the locks 17. The deformation preventing portions 32 that fit into the deformation permitting spaces 19B at the lower stage contact the upper surfaces of the thin sides 17B and the excessive deformation preventing portions 21 on the lower surfaces of the partition walls 20 to prevent deformation of the locks 17. In this way, the deformation preventing portions 32 are inserted into recessed spaces formed by a difference in the thickness of the thick middle 17A and thin sides 17B of the locks 17.

The connector further includes terminal fittings 40. Each terminal fitting 40 is narrow and long in forward and backward directions and is formed by bending, embossing and/or folding a metallic plate material stamped or cut into a specified shape. A longitudinal middle portion of the terminal fitting 40 is formed into a substantially rectangular tube 41 with first and second side plates that stand up at the opposite lateral edges of a bottom plate. Inner plates 42 extend in from the front and rear ends of the upper edge of first side plate, and outer plates 43 extend in from the front and rear ends of the upper edge of the second side plate. The outer plates 43 are placed on the upper or outer surfaces of the inner side plates 42. A receiving plate 44 extends in from a substantially middle part of the upper edge of the first side plate between the two inner plates 42 and is engaged with the upper end of the second side plate. The rear ends of the front inner and outer plates 42 and 43 are substantially vertically continuous and flush with each other to define a securing portion 45.

An upside-down insertion preventing portion 46 is formed by making a cut in the bottom plate of the rectangular tube 41 at a substantially widthwise middle position near the front end and bending this cut portion down out. Alternatively, the upside-down insertion preventing portion 46 may be formed by embossing. The front surface of the upside-down insertion preventing portion 46 is substantially normal to the inserting direction ID of the terminal fitting 40 into the cavity 11. The upside-down insertion preventing portion 46 is disposed such that a distance between the front wall 14 of the cavity 11 and the upside-down insertion preventing portion 46 with the terminal fitting 40 inserted to a proper insertion position is less than a distance between the front wall 14 and the front end of the lock 17 (see FIG. 5(*a*)). Thus, the upside-down insertion preventing portion 46 of the terminal fitting 40 inserted into the cavity 11 at the upper stage directly faces the corresponding cavity 11 at the lower stage through the deformation permitting space 19A of the partition wall 20. However, this upside-down insertion preventing portion 46 will not interfere with the lock 17 at the lower stage when the terminal fitting 40 is inserted properly.

A coupling portion 47 is formed at the front of the rectangular tube 41 and tapers toward the front in a substantially pyramidal shape. The bottom plate and the opposite side plates of the coupling portion 47 are substantially continuous with those of the rectangular tube 41, and the upper plate of the coupling portion 47 extends in from the upper edge of one side plate thereof. An overlay plate 48 extends from the front end of the front outer plate 43 of the rectangular tube 41 and slopes moderately down to the front. The overlay plate 48 is placed on the outer surface of the upper plate of the coupling portion 47. The front end of the overlay plate 48 substantially reaches the front end of the coupling portion 47 and a long narrow tab 49 projects forward from the coupling portion 47. The front end of the overlay plate 48 is curved slightly so as to be substantially parallel with the inserting direction ID of the terminal fitting 40 into the cavity 11. A contact surface 50 is defined at the front end of the overlay plate 48 and is substantially normal to the inserting direction ID of the terminal fitting 40 into the cavity 11.

The tab 49 is formed by vertically folding a plate piece extending forward from the upper and lower plates and one side plate of the coupling portion 47 into a U-shape, such that upper and lower parts of the folded plate face each other. Thus, the tab 49 is connectable with an unillustrated mating female terminal fitting. A wire connecting portion 52 extends from the rear end of the rectangular tube 41. The wire connecting portion 52 is in the form of an open barrel formed by bending or folding pieces that stand up from the opposite lateral edges of a bottom plate. The wire connecting portion 52 is crimped, bent or folded into connection with an insulation coating 53*a* and a core 53*b* of a wire 53. A watertight rubber plug 54 is mounted on the wire 53 behind the wire connecting portion 52 and is insertable into the housing 10 for contact with the sealing surface 12.

Figure 4:
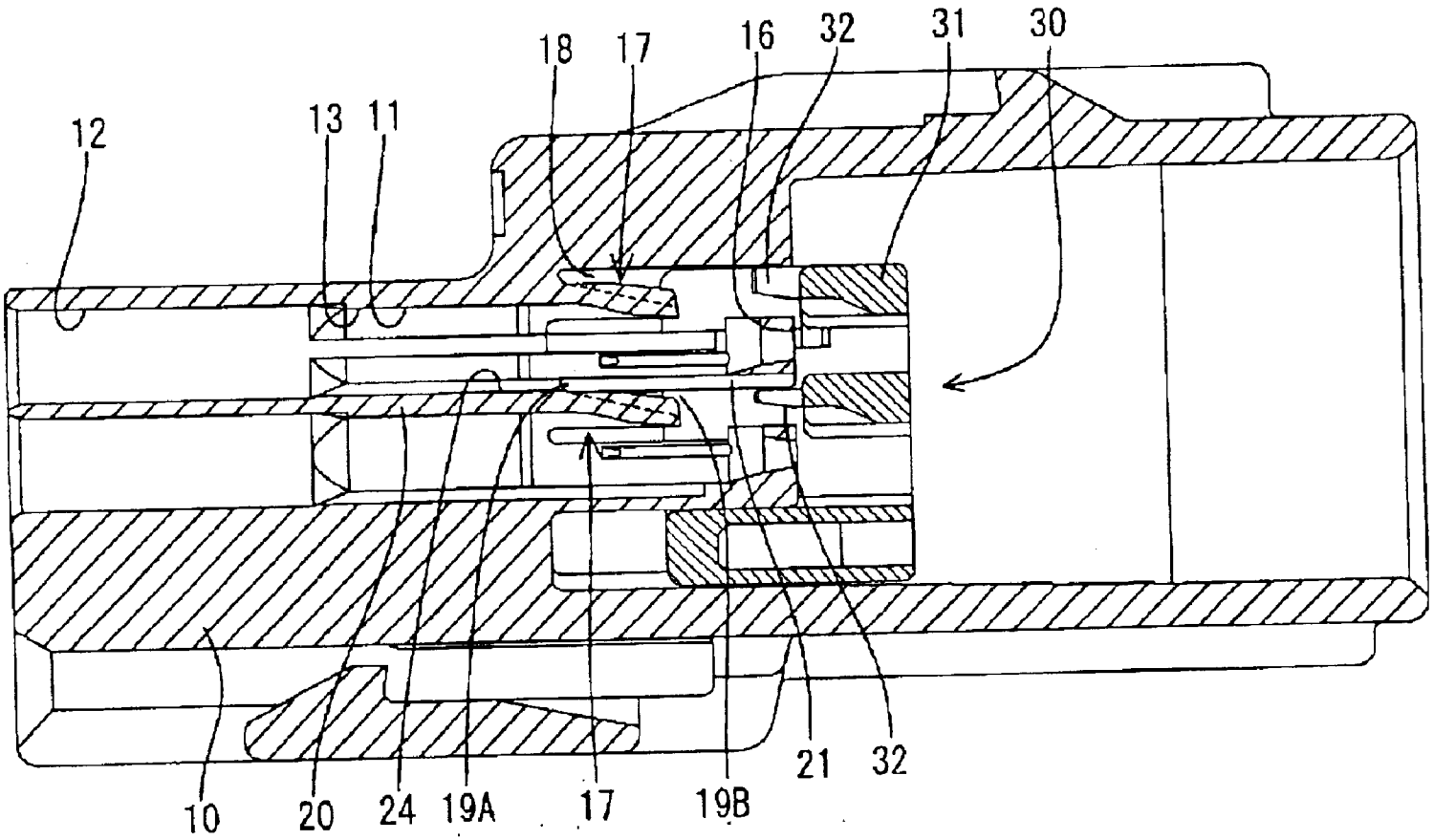
FIG. 4 is a section showing a state where the front retainer is held at a partial locking position in the housing.
Figure 5:
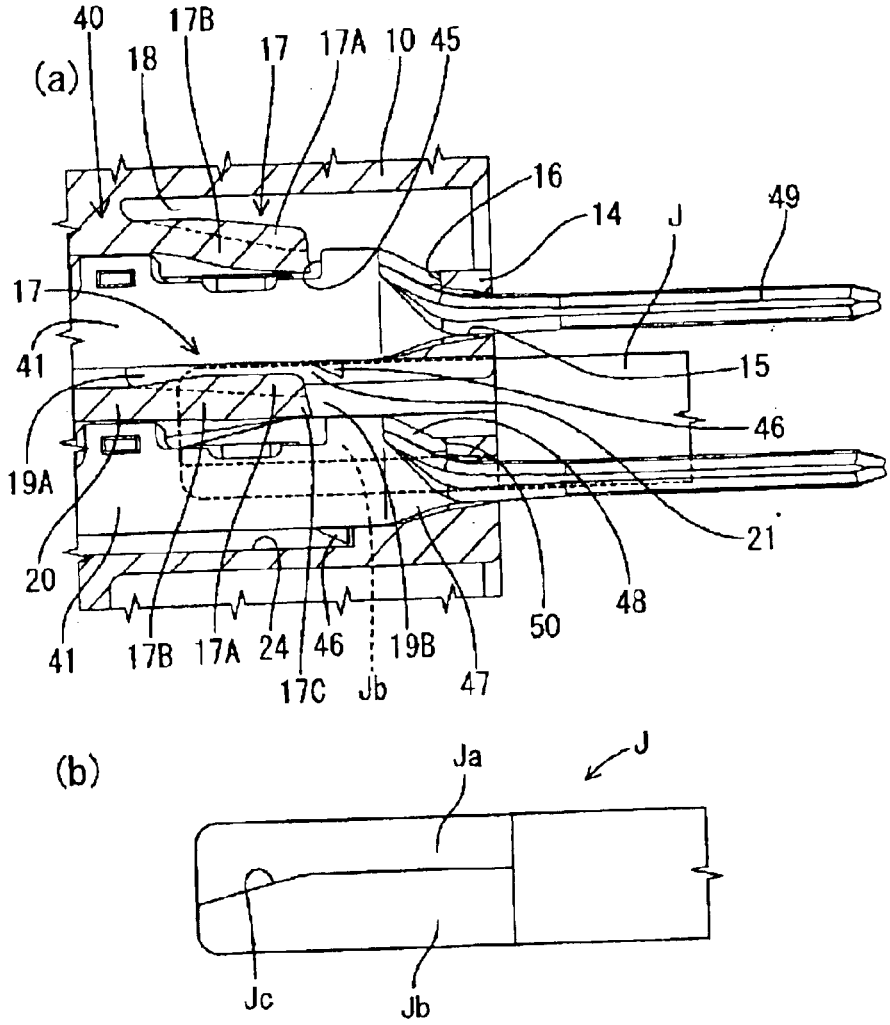
FIGS. 5(*a*) and 5(*b*) are a section showing a state where a lock is resiliently deformed by a withdrawing jig to free a terminal fitting from its locked state, and a side view of the withdrawing jig, respectively.

The connector of this embodiment is assembled by first mounting the front retainer 30 at a partial locking position in the housing 10. The deformation preventing portions 32 are spaced forward from the front ends of the locks 17, as shown in FIG. 4, when the front retainer 30 is at the partial locking position. Thus, the locks 17 can deform toward the deformation permitting spaces 18, 19A, 19B. Each terminal fitting 40 then is inserted in the inserting direction ID into the corresponding cavity 11. The front end of the upper surface of the rectangular tube 41 contacts the lower surface of the lock 17 when the terminal fitting 40 nears the proper insertion position. Thus, the lock 17 resiliently deforms up away from the terminal fitting 40 and into the deformation permitting space 18 or 19A, 19B. The front end of the front outer plate 43 of the terminal fitting 40 is smoothly continuous with the overlay plate 48 that extends obliquely down. Accordingly, there is no possibility of damaging the lower surface of the lock 17.

The lock 17 is restored resiliently when the terminal fitting 40 reaches the proper insertion position and the locking section 17C at the front end of the lock 17 engages the securing portion 45 on the upper surface of the rectangular tube 41 from behind. As a result, the terminal fitting 40 is locked and cannot make loose backward movements. Further, the contact surface 50 of the terminal fitting 40 contacts the receiving surface 16 of the cavity 11 to prevent any further forward movement of the terminal fitting 40. Both the contact surface 50 and the receiving surface 16 are substantially normal to the inserting direction ID of the terminal fitting 40 into the cavity 11. Accordingly, the terminal fitting 40 can be held precisely at its front-limit position.

The upside-down insertion preventing portion 46 projects from the bottom surface of the rectangular tube 41 and moves along the escaping groove 24 in the bottom surface of the cavity 11 during the insertion of the terminal fitting 40. A front end of the escaping groove 24 of each cavity 11 at the upper stage shares the space with the deformation permitting space 19A. The tab 49 projects out of the housing 10 through the opening 15 at the leading end of the cavity 11 when the terminal fitting 40 is inserted properly. The rubber plug 54 is held in close contact with the sealing surface 12 at the rear end of the cavity 11 to prevent the entrance of water into the cavity 11 from behind.

The front retainer 30 is pushed to a full locking position, as shown in FIG. 1, after all of the terminal fittings 40 are inserted. Thus, the deformation preventing portions 32 enter the deformation permitting spaces 18, 19B to face the upper surfaces of the thin sides 17B of the locks 17. Contact of the thin sides 17B with the deformation preventing portions 32 prevent the locks 17 from being deformed toward the deformation permitting spaces 18, 19A, 19B and thus the locks 17 are held while being engaged with the terminal fittings 40. In this way, the terminal fittings 40 are locked doubly and are prevented from coming out.

A terminal fitting 40 might be inserted insufficiently when the front retainer 30 is pushed toward the full locking position. However, the lock 17 deformed by this terminal fitting 40 is still in the deformation permitting space 18, 19B. Thus, the deformation preventing portions 32 contact the lock 17 and the front retainer 30 cannot be pushed any further. Therefore, the presence of the insufficiently inserted terminal fitting 40 can be detected.

Figure 6:
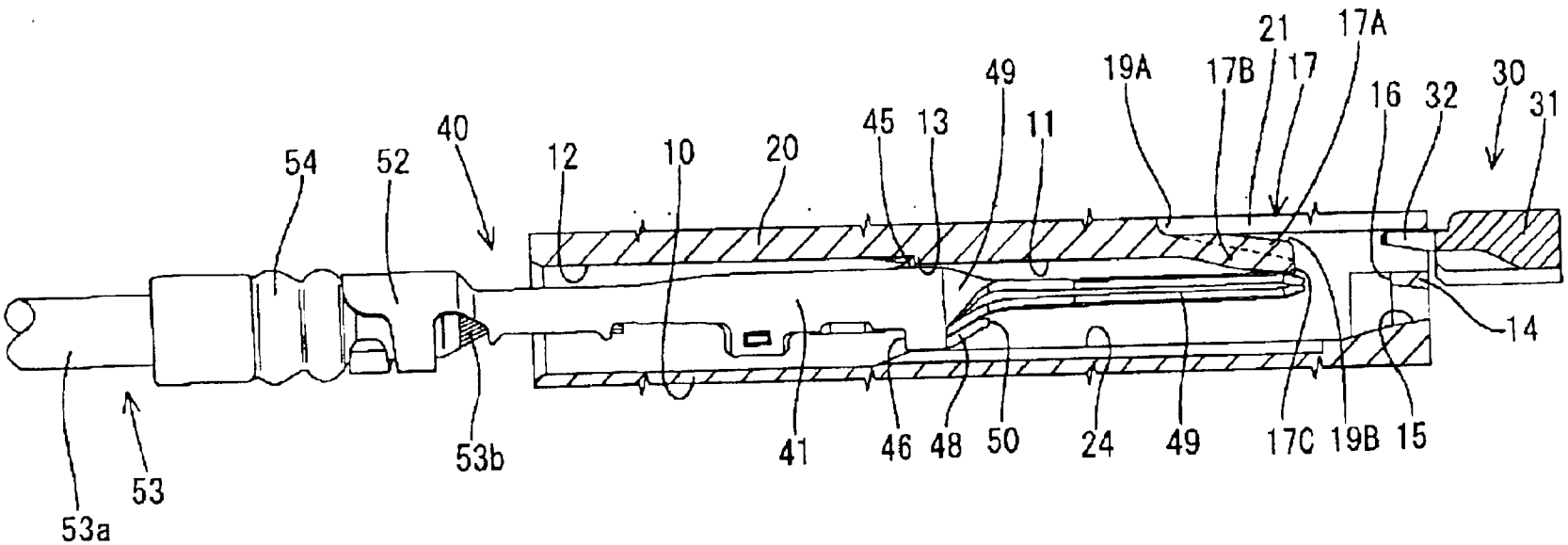
FIG. 6 is a section showing a state where the terminal fitting is inserted upside down.
Figure 7:
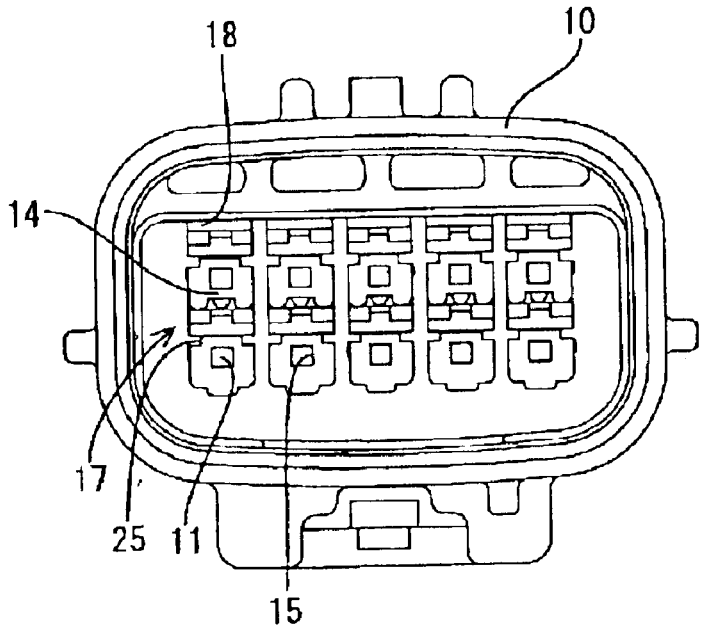
FIGS. 7(*a*) and 7(*b*) are a front view of only the housing, and a front view of the housing having the front retainer mounted therein, respectively.
Figure 7:
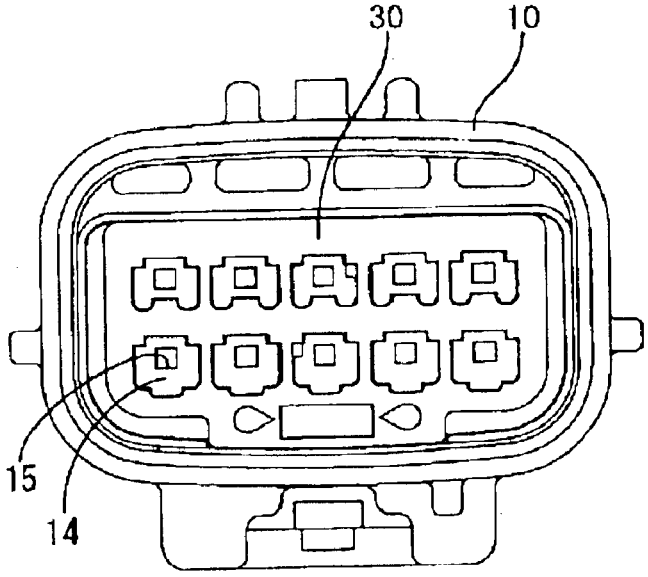

An attempt might be made to insert a terminal fitting 40 upside down. However, the upside-down insertion preventing portion 46 of the terminal fitting 40 engages the receiving portion 13 of the cavity 11 from behind, as shown in FIG. 6, and further insertion of the terminal fitting 40 is hindered. An operator can notice that the terminal fitting 40 is held upside down by this hindrance to the inserting operation. The front end of the tab 49 cannot reach the front wall 14 of the cavity 11 if the insertion is hindered in this way because the distance between the front wall 14 of the cavity 11 and the receiving portion 13 exceeds the distance between the upside-down insertion preventing portion 46 and the leading end of the tab 49.

Figure 8:
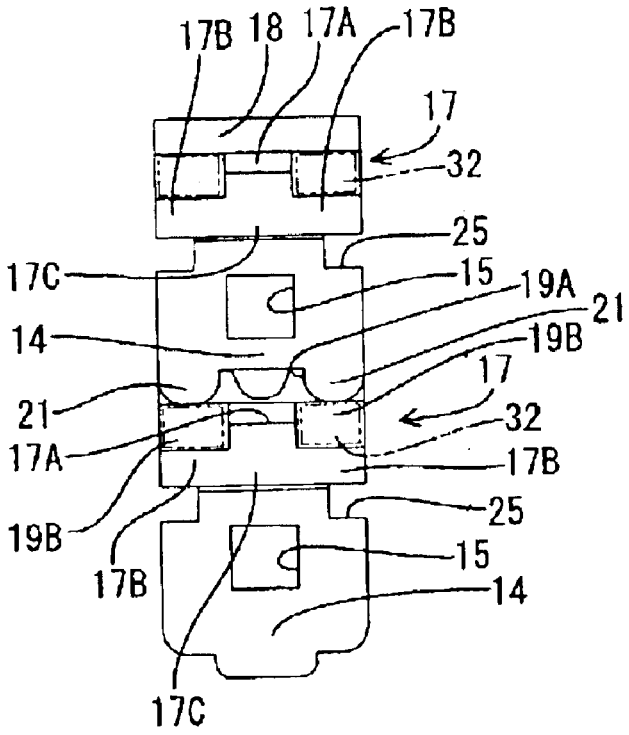
FIG. 8 is a partial enlarged front view of the housing.
Figure 9:
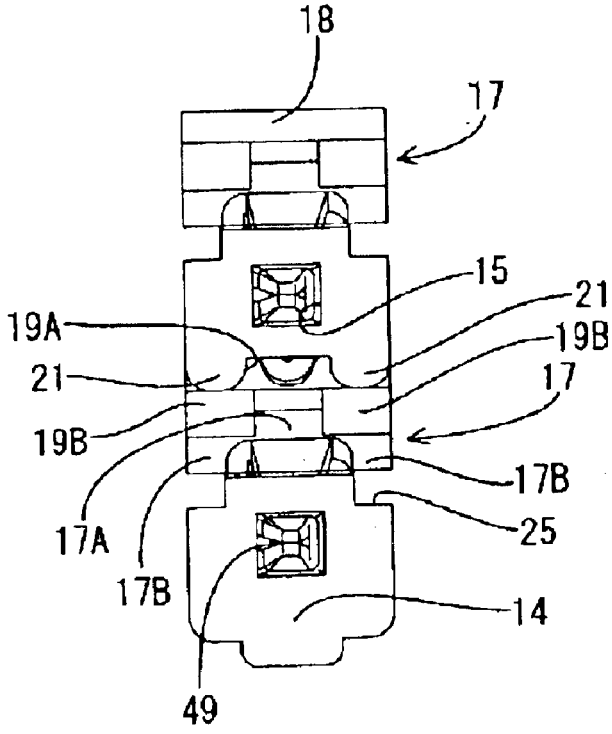
FIG. 9 is a partial enlarged front view of the housing with the terminal fittings inserted.
Figure 10:
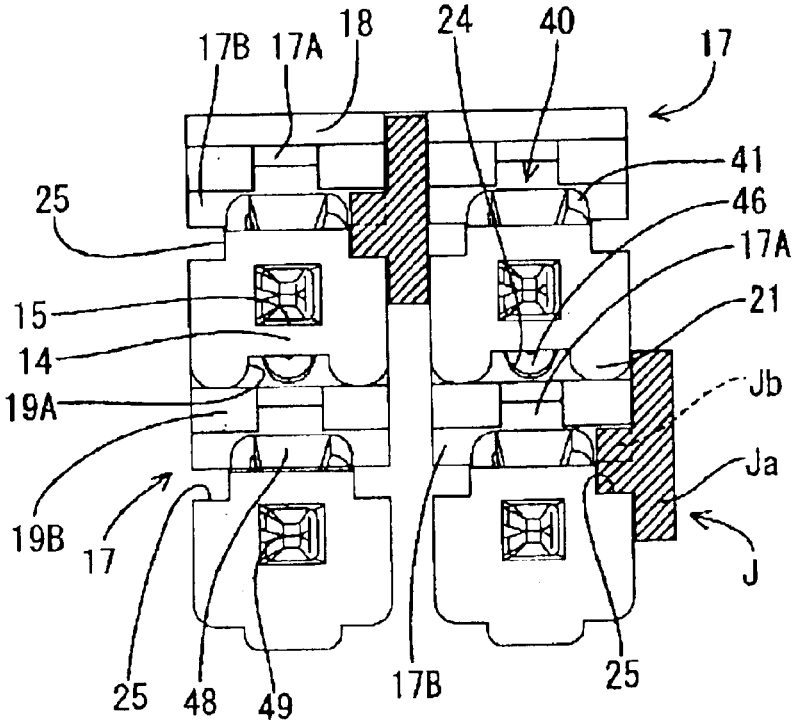
FIG. 10 is a partial front view showing a positional relationship between the locks and the withdrawing jigs.
Figure 11:
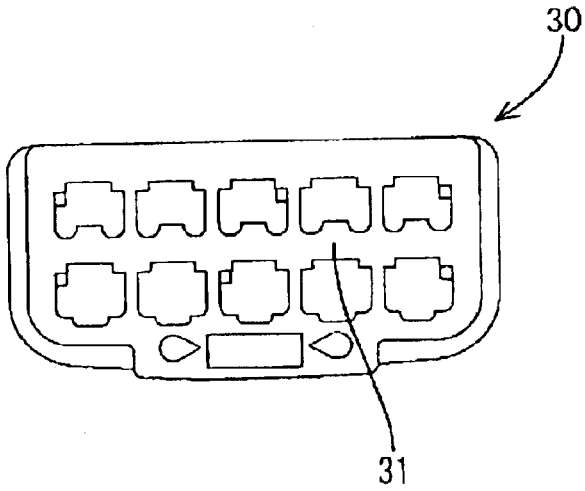
FIG. 11 is a front view of the front retainer.
Figure 12:
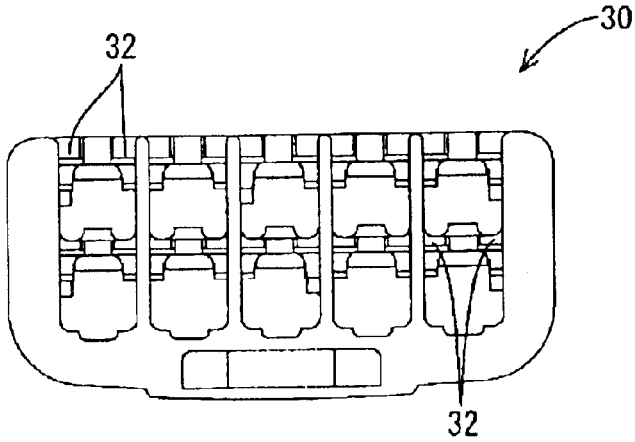
FIG. 12 is a rear view of the front retainer.
Figure 13:
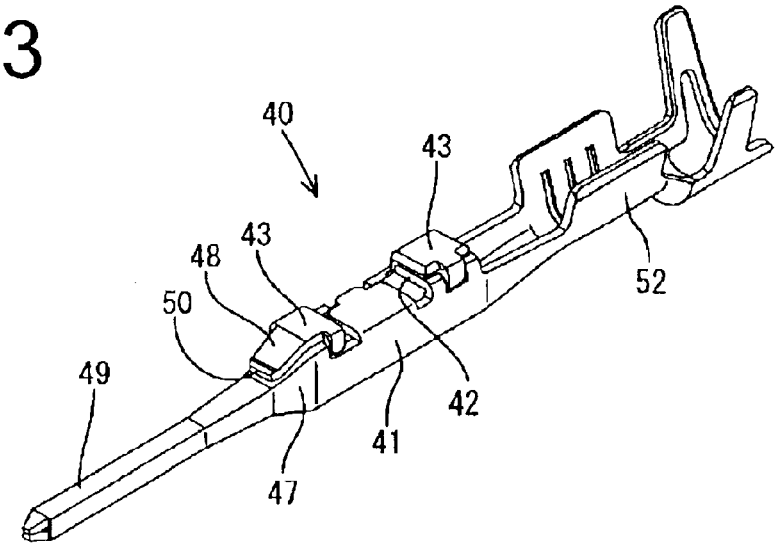
FIG. 13 is a perspective view of the terminal fitting.
Figure 14:
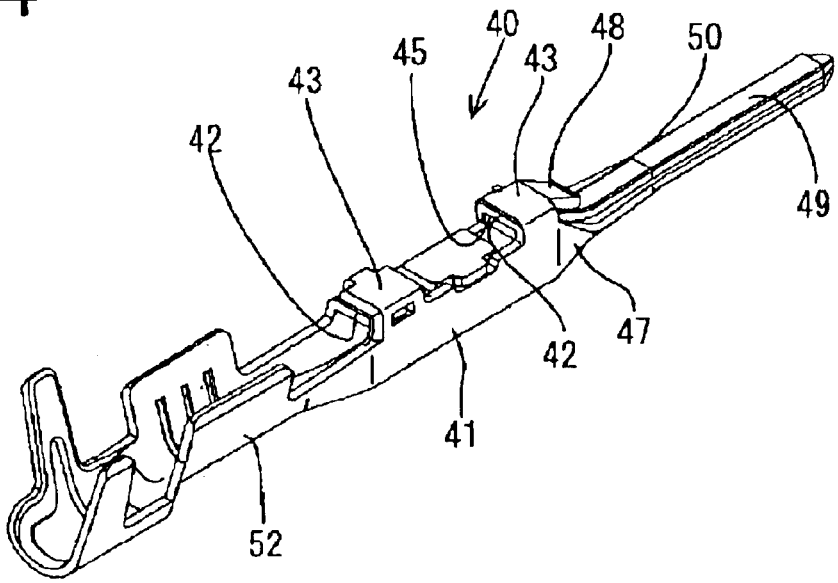
FIG. 14 is a perspective view of the terminal fitting.
Figure 15:
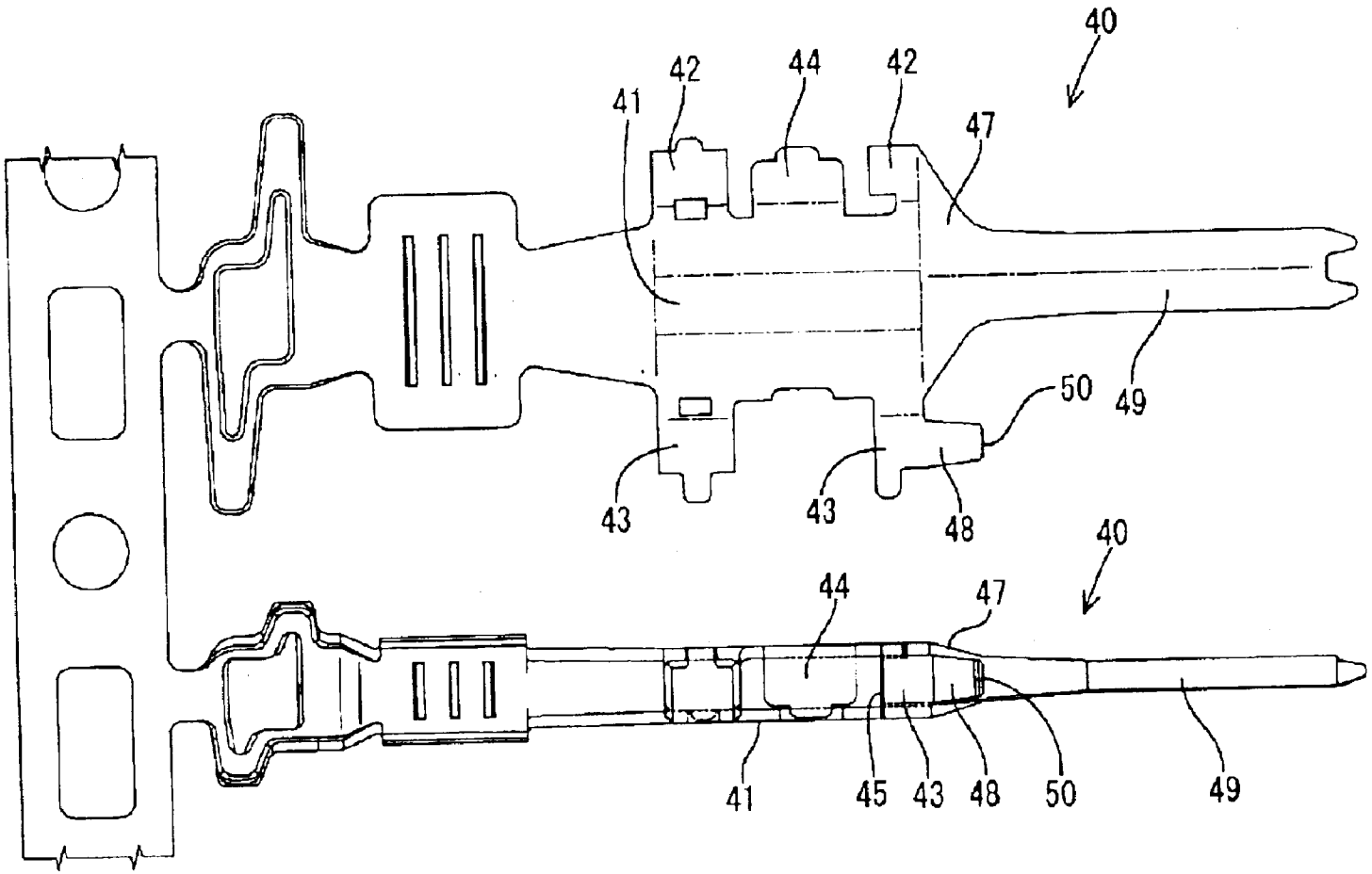
FIG. 15 is a plan view showing a manufacturing process of terminal fittings.
Figure 16:
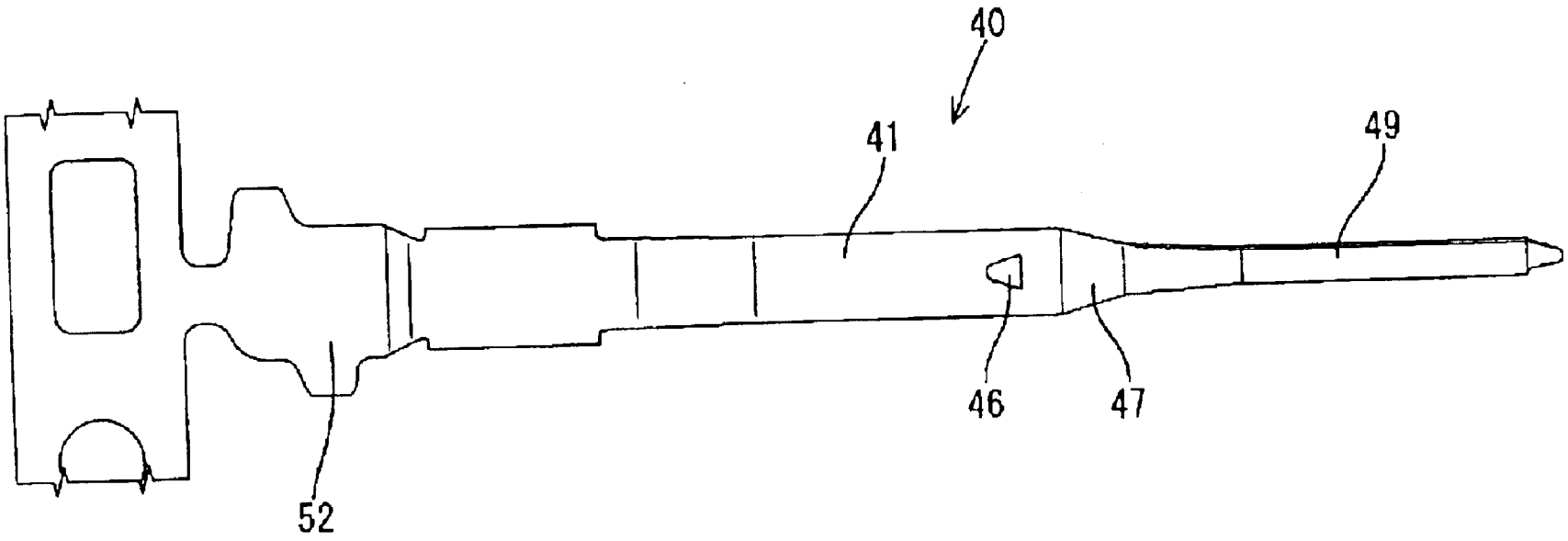
FIG. 16 is a bottom view of the terminal fitting.

The inserted terminal fitting 40 is withdrawn by first detaching the front retainer 30 from the housing 10. A withdrawing jig J then is inserted into the housing 10 from the front. The withdrawing jig J has a long base plate Ja, a pushing portion Jb that projects from a side of the base plate Ja, and a slanted guide surface Jc at the leading end of the pushing portion Jb with respect to an inserting direction of the withdrawing jig J into the housing 10. The locks 17 are wider than the terminal fittings 40 so that the thin sides 17B of the locks 17 project laterally beyond the terminal fittings 40, as shown in FIGS. 8 to 10. The upper ends of the side walls of the cavities 11 are cut to be lower than the upper surfaces of the thin sides 17B of the locks. Additionally, withdrawal spaces 25 are defined between the upper ends of the side walls and the lower surfaces of the thin sides 17B and open at the front end surface of the housing 10. The pushing portion Jb can be inserted into the withdrawal space 25 so that the guide surface Jc contacts the lower surface of the thin side 17B. Thus, the lock 17 is deformed up by the inclination of the guide surface Jc to disengage the locking section 17C at the front end of the lock 17 from the securing portion 45 of the terminal fitting 40 as the withdrawing jig J is inserted further. In this way, the terminal fitting 40 is freed from its locked state, and the terminal fitting 40 can be withdrawn from the cavity 11 by pulling on the wire 53.

The locks 17 at the lower stage also are part of the partition walls 20 between the vertically adjacent cavities 11 for achieving miniaturization. Additionally, the upside-down insertion preventing portions 46 and the locks 17 are arranged so as not to interfere with each other along the inserting direction ID of the terminal fittings 40. Accordingly, the upside-down insertion preventing portions 46 do not interfere with the vertically adjacent locks 17 at the lower stage even though both the upside-down insertion preventing portions 46 and the locks 17 are near the front end and are on opposite sides. Therefore, insertion resistance can be reduced and early detection of an upside-down insertion can be realized by causing the locks 17 to serve as the partition walls 20 between the vertically adjacent cavities 11 for the miniaturization of the connector and enabling both the upside-down insertion preventing portions 46 and the locks 17 to be near the front.

The front end of the tab 49 has not yet reached the front wall 14 when any further insertion of an upside down terminal fitting 40 is prevented by contact of the upside-down insertion preventing portion 46 with the receiving portion 13. Thus, the tab 49 will not strike against the front wall 14 and be deformed.

Each lock 17 has the thin sides 17B and each partition wall 20 between vertically adjacent cavities 11 has the excessive deformation preventing portions 21. Thus, excessive deformation of the lock 17 beyond its resiliency limit can be prevented, while the desired resilient deformation of the lock 17 is permitted.

Each lock 17 has the thick middle 17A and the thin sides 17B formed by partially cutting the upper surface of the lock 17 facing the deformation permitting spaces 18, 19A, 19B along a widthwise direction. The deformation preventing portions 32 are inserted into the spaces formed by the difference in thickness between the thick middle 17A and the thin sides 17B and contact the upper surfaces of the thin sides 17B to prevent deformation of the lock 17. Thus, the locks 17 and the deformation preventing portions 32 overlap along thickness direction, which is the deformation direction of the lock 17, and the connector can be made smaller due to overlapping thickness.

Each lock 17 is thinned over part of the entire width, and therefore a sufficient strength is secured for the entire lock 17. Further, the deformation permitting spaces 19B corresponding to the thin sides 17B have a large height, and the thickness of the deformation preventing portions 32 that contact the thin sides 17B can be made larger so that a sufficient strength can be secured for the deformation preventing portions 32.

The deformation permitting space 19A for the thick middle 17A is formed by partially cutting a center portion of each partition wall 20 between the vertically adjacent cavities 11. Additionally, the deformation preventing portions 32 fit into the deformation permitting spaces 19B between the thin sides 17B and the partition wall 20 that separates vertically adjacent cavities 11. Thus, the deformation permitting spaces 19A for the thick middles 17A of the locks 17 at the lower stage and the partition walls 20 between the vertically adjacent cavities 11 overlap along the vertical direction, which is the deflection direction of the lock 17. Therefore, the connector can be made shorter by this overlapping thickness.

The thick middle 17A of each lock 17 projects more toward the deformation permitting space than the thin sides 17B. Thus, a degree of the resilient deformation of the lock 17 is restricted. However, the deformation permitting space 19A for the thick middle 17A is formed in the partition wall 20 between the vertically adjacent cavities 11. Thus, the degree of the resilient deformation of the lock 17 can be larger, and an area of engagement of the lock 17 and the terminal fitting 40 is increased to lock the terminal fitting 40 with improved reliability.

The deformation permitting space 19A for the thick middle 17A of the locks 17 in the lower stage communicates with the cavities 11 above the partition wall 20. Thus, the lock 17 can be deformed more than with a deformation permitting space formed merely by a groove in a partition wall. The deformation of the lock 17 cannot be restricted by the contact of the thick middle 17A of the lock 17 with the partition wall 20 because the deformation permitting space 19A communicates with the vertically adjacent cavities 11. However, the excessive deformation preventing portions 21 are provided in the areas of the partition wall 20 corresponding to the thin sides 17B. Therefore, the lock 17 is prevented from excessive deformation.

The lock 17 is substantially transversely symmetrical. Thus, the rigidity of the lock 17 also is transversely symmetrical, and the lock 17 is not displaced to the left or right side when being deformed during insertion of the terminal fitting 40.

The male terminal fitting 40 inserted into the cavity 11 along the insertion directing ID and is stopped at its front-limit position by contact between the contact surface 50 of the terminal fitting 40 and the receiving surface 16 in the cavity 11. Thus, the male terminal fitting 40 is stopped at the specified proper insertion position and will not move further forward in the inserting direction ID.

The coupling portion 47 of the terminal fitting 40 is formed with a press that deforms the front end of the rectangular tube 41 into a tapered shape, and hence the coupling portion 47 is potentially weak. However, the coupling portion 47 is reinforced by the overlay plate 48 and is not likely to deform.

The outer edge of the contact surface 50 of the terminal fitting 40 is a sharp edge, but is more inward than the outer surface of the rectangular tube 41 since the contact surface 50 is at the front end of the tapered coupling portion 47. Accordingly, the outer edge of the contact surface 50 does not damage the inner walls during the insertion of the male terminal fitting 40.

The front outer plate 43 and the overlay plate 48 of the rectangular tube 41 are made of a single plate, and a boundary between them at the front end of the rectangular tube portion 41 is a relatively smoothly bent surface having no sharp edge. Thus, the front end of the rectangular tube 41 will not damage the inner wall portions of the cavity 11 during the insertion of the male terminal fitting 40.

The lock 17 engages the double-plate portion formed by the inner and outer plates 42, 43 of the rectangular tube 41. Thus, a larger area of engagement can be attained as compared to a case where the lock is engaged with a portion formed by cutting a single plate.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

Although the upside-down insertion preventing portion is provided before the lock in the foregoing embodiment, it may be provided behind the locking position according to the present invention.

Although the invention is applied to a male terminal fitting having a tab in the foregoing embodiment, it is also applicable to female terminal fittings.

What is claimed is:

1. A connector, comprising:

terminal fittings, a housing formed with at least first and second cavities into which the corresponding terminal fittings are insertable, the first cavity having a top wall and first and second side walls, the second cavity having a bottom wall end first and second side walls, a partition wall formed between the cavities, the partition wall including a first deformation preventing wall adjacent the first side walls of the first and second cavities and a second deformation preventing wall adjacent the second side walls of the first and second cavities, the first and second deformation preventing walls being spaced from one another, first and second resiliently deformable locks provided in the respective first and second cavities for engaging and locking the terminal fittings, the second lock being formed unitarily with the partition wall and having a central thick middle disposed between the first and second deformation preventing walls, a first thin portion between the first deformation preventing wall and the second cavity and a second thin portion between the second deformation preventing wall and the second cavity, wherein the second locks forms parts of the partition walls between the first and second cavities.

2. The connector of claim 1, wherein the terminal fittings each are formed with an upside-down insertion-preventing portion disposed for slidable insertion between the first and second deformation preventing walls in a proper rotational orientation of the terminal fitting in the first cavity.

3. The connector of claim 2, wherein the upside-down insertion-preventing portions are at positions so as not to interfere with the locks along an inserting direction of the terminal fittings.

4. The connector of claim 3, wherein each said cavity is formed with a receiving portion for contacting the upside-down insertion-preventing portion when the terminal fitting is inserted upside down and preventing any further insertion of the terminal fitting.

5. The connector of claim 4, wherein each terminal fitting has a tab projecting forward through an opening in a front wall of the corresponding cavity when the terminal fitting is inserted properly.

6. The connector of claim 5, wherein the receiving portion is at a position to contact the upside-down insertion-preventing portion before the front end of the tab strikes the front wall of the cavity.

7. The connector of claim 1, wherein the lock is wider than the terminal fitting.

8. The connector of claim 7, wherein the thin portion projects laterally beyond the terminal fitting.

9. The connector of claim 1, wherein each said cavity comprises a receiving surface arranged substantially normal to an inserting direction of the terminal fitting into the cavity, the terminal fitting at a proper insertion position being prevented from movement in the inserting direction by engagement of the receiving surface with a cooperating portion of the terminal fitting.

10. The connector of claim 1, further comprising a retainer insertable substantially along the inserting direction to doubly lock the terminal fittings in the cavities.

11. A connector, comprising:

terminal fittings, each said terminal fitting having opposite front and rear ends, a barrel disposed adjacent said rear end and configured for connection to a wire, a male tab formed adjacent said front end and configured for mating with another terminal fitting, a tubular portion between said barrel and said tab, said tubular portion being formed to define a locking surface and an upside-down insertion-preventing portion substantially opposite said locking surface, said locking surface being closer to said tab than to said barrel and said upside-down insertion-preventing portion being spaced from said tab by a distance no greater than a distance between said locking surface and said tab, a housing formed with a plurality of cavities into which the corresponding terminal fittings are insertable, locks provided in the respective cavities for engaging and locking the terminal fittings, wherein some locks form at least parts of partition walls between adjacent cavities.

12. The connector of claim 11, wherein the upside-down insertion-preventing portions are at positions so as not to interfere with the locks along an inserting direction of the terminal fittings.

13. The connector of claim 12, wherein each said cavity is formed with a receiving portion for contacting the upside-down insertion-preventing portion when the terminal fitting is inserted upside down and preventing any further insertion of the terminal fitting.

14. The connector of claim 13, wherein the housing has a front wall with openings for receiving the tabs of the respective terminal fittings when the terminal fittings are inserted properly into the cavity.

15. The connector of claim 14, wherein the receiving portion is at a position to contact the upside-down insertion-preventing portion before the front end of the tab strikes the front wall of the cavity.

* * * * *